United States Patent [19]

Banford

[11] Patent Number: 4,512,124

[45] Date of Patent: Apr. 23, 1985

[54] RIGIDIFIED DOORWAY

[75] Inventor: Dennis W. Banford, Evans, Ga.

[73] Assignee: Peachtree Doors, Inc., Norcross, Ga.

[21] Appl. No.: 519,505

[22] Filed: Aug. 2, 1983

[51] Int. Cl.[3] ..... E06B 1/04

[52] U.S. Cl. ..... 52/207; 52/208; 52/311; 52/582; 49/501; 49/381

[58] Field of Search ..... 52/207, 208, 489, 508, 52/509, 582, 584, 311; 49/501, 504, 381

[56] References Cited

U.S. PATENT DOCUMENTS

| | | | |
|---|---|---|---|
| 2,142,305 | 1/1939 | Davis | 52/582 X |
| 2,430,615 | 11/1947 | Levine | 52/582 X |
| 2,504,701 | 4/1950 | Krantz | 52/208 X |
| 2,752,013 | 6/1956 | Cole | 52/584 X |
| 2,759,779 | 8/1956 | Bergman | 52/582 |
| 3,219,383 | 11/1965 | Nerem | 52/582 X |
| 3,376,678 | 4/1968 | Thygeson, Sr. | 52/584 X |
| 4,167,088 | 9/1979 | Governale | 52/207 |

*Primary Examiner*—J. Karl Bell
*Assistant Examiner*—Richard E. Chilcot, Jr.
*Attorney, Agent, or Firm*—Kimmel, Crowell & Weaver

[57] ABSTRACT

Two or more fixed doorway panels are permanently interconnected through bracket components carried by opposing vertical edges of the fixed panels which simulate door hinges. A horizontally swinging hinged door is mounted on the endmost fixed panel through hinges which further rigidify the doorway structure.

2 Claims, 3 Drawing Figures

RIGIDIFIED DOORWAY

BACKGROUND OF THE INVENTION

The general objective of this invention is to improve the rigidity and stability of doorway structures composed of two or more fixed panels and a hinged horizontally swinging door. In the prior art, doorway structures of this type have tended to weaken and loosen over a period of time and the hinged door which is supported on an endmost fixed panel may sag and drag on the door sill.

Another object of the invention is to provide rigidifying means in a multi-panel doorway structure of this type including interlocking elements on the fixed panels which closely simulate hinges, thus contributing to the aesthetic appearance of the doorway.

Other features and advantages of the invention will become apparent to those skilled in the art during the course of the following description.

DETAILED DESCRIPTION

Figures 1, 2, 3:
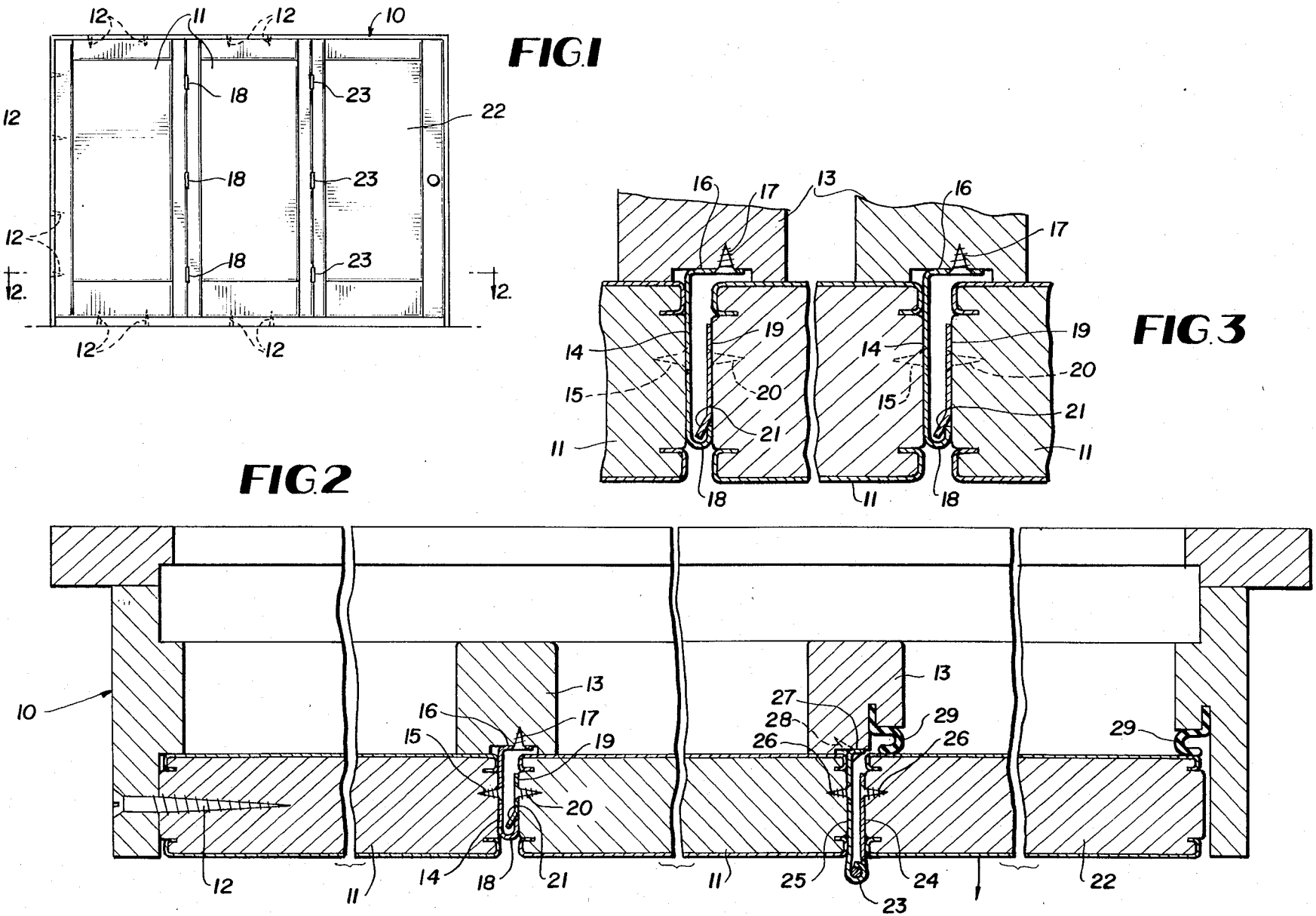
FIG. 1 is an interior elevation of a rigidified doorway according to the present invention.
FIG. 2 is an enlarged fragmentary horizontal section taken on line 2—2 of FIG. 1.
FIG. 3 is a further enlarged fragmentary horizontal section through an adjacent pair of fixed doorway panels connected by interlocking edge components which simulate door hinges.

Referring to the drawings in detail wherein like numerals designate like parts, a rigidified doorway in accordance with the invention comprises a rectangular perimeter frame 10 of conventional construction into which any desired and practical number of fixed doorway panels 11 are fitted and anchored rigidly to the frame 10 at their tops and bottoms by long screws 12 to provide rigidity to the structure. The endmost fixed panel 11 is further anchored and rigidified along one vertical edge by additional screws 12. FIG. 1 illustrates a doorway structure having two of the fixed panels 11 as does FIG. 2. FIG. 3 indicates that three or more of the fixed panels may be employed, depending on the size of the doorway being constructed.

The permanently installed fixed panels 11 of the doorway are further rigidified and tied together horizontally, one relative to another, and also tied to vertical stiles 13 which are integral parts of the perimeter frame 10 in the following manner, according to the main feature of the invention.

On one vertical edge of each fixed panel 11 is mounted preferably three bracket plates 14 securely anchored by screws 15, each such plate having an exterior right angle lateral flange 16 anchored to a stile 13 by further screws 17. This arrangement ties each panel 11 at three points along its vertical height to one of the styles 13 and hence to the main perimeter frame 10.

At its opposite or interior end, each bracket plate 14 carries a curved knuckle 18 whose appearance, when viewed from the interior of the doorway, FIG. 1, closely simulates the appearance of a conventional swinging door hinge. The knuckles 18 lie in narrow spaces formed between opposing vertical edges of the fixed panels 11 somewhat forwardly of their interior faces.

Cooperating tongue plates 19 are secured by screws 20 to the opposing vertical edges of the panels 11 and these plates have inclined vertical flanges or tongues 21 which interlock within and behind the rigid knuckles 18 and are concealed from view by the knuckles 18 while serving to lock the adjacent panels 11 together laterally or horizontally at three points along the height of the doorway, FIG. 1. The arrangement adds rigidity to the doorway structure while improving its aesthetic appearance, as explained.

The remainder of the doorway opening defined by frame 10 is occupied by a hinged horizontally swinging door 22 of any preferred construction. The door 22 is hung on the vertical edge of the adjacent endmost fixed panel 11 through hinges 23 which, from the interior of the doorway, closes resemble the appearance of the knuckles 18, and are arranged in the same vertically spaced relationship as the knuckles 18. The leaves 24 and 25 of each hinge 23, FIG. 2, are anchored by screws 26 to the door 22 and fixed panel 11. Further, each leaf 25 has a short lateral right angular extension 27 abutting the adjacent stile 13 and being anchored thereto by further screws 28 engaging through apertures at the bend line between leaf 25 and flange 27. Thus, the screws 28 are disposed diagonally with respect to the vertical plane occupied by panels 11 and swinging door 22. The arrangement strengthens the door 22 aganst sagging and further rigidifies the doorway structure by tying the door and the adjacent fixed panel 11 through the hinges 23 and stile 13 to the main frame 10.

The swinging door 22 is equipped with conventional weather seals 29 or other forms of stripping, as desired.

In the construction of the doorway, after installation of the perimeter frame 10, the first fixed panel 11 at the left hand side of FIG. 1 is placed in the frame 10 and anchored by the screws 12 at its top, bottom and along one side. The angled tongues 21 are slipped into interlocking engagement with the knuckles 18 easily by a horizontal placement and pivoting movement of the next panel 11 until it is properly placed in the frame 10. The top and bottom anchor screws 12 are then placed through the frame 10 and panel 11. This procedure is repeated for each additional fixed panel 11 being employed. Finally, the swinging door 22 is hung by its hinges 23 and a very rigid and stable doorway structure is completed.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A doorway structure comprising a doorway frame including spaced vertical stiles, at least a pair of fixed doorway panels within said doorway frame and a horizontally swingable door within said frame on one side of one fixed panel, the fixed panels and said door occupying a common vertical plane when the door is closed and there being narrow vertical spaces between the fixed panels and between the door and the adjacent fixed panel, vertical edge portions of the fixed panels and door overlapping forward faces of said stiles, vertically spaced hinges for said door including pairs of hinge leaves fixed to opposing vertical edges of the door and said one fixed panel and being disposed within one of said narrow vertical spaces, the hinges including vertically extending pins and knuckles disposed immediately forwardly of the last-named narrow vertical space, and interlocking connectors for the fixed panels within the narrow vertical spaces between the fixed panels, said connectors being disposed at the heights of said hinges and corresponding in number to said hinges and having the same vertical lengths as said hinges to simulate the appearance of said hinges to an observer of the front of the doorway structure, said connectors including opposing bracket plates and tongue plates fixed to opposing vertical edges of the fixed panels and being disposed within said narrow vertical spaces, the bracket plates including curved simulated hinge knuckle elements on their forward ends within the narrow vertical spaces, and the tongue plates including angled tongues on their forward ends within said vertical spaces which are interlocked within said simulated knuckles.

2. A doorway structure as defined in claim 1, and lateral vertical flanges on the interior ends of the bracket plates and being fixedly secured to said stiles.

* * * * *